US005553995A

United States Patent [19]

Martinez

[11] Patent Number: 5,553,995

[45] Date of Patent: Sep. 10, 1996

[54] METHOD OF DRIVING A TURBINE IN ROTATION BY MEANS OF A JET DEVICE

[76] Inventor: Michèle Martinez, 82210 St. Nicolas de la Grave, France

[21] Appl. No.: 211,490

[22] PCT Filed: Oct. 9, 1992

[86] PCT No.: PCT/FR92/00957

§ 371 Date: Apr. 7, 1994

§ 102(e) Date: Apr. 7, 1994

[87] PCT Pub. No.: WO93/07361

PCT Pub. Date: Apr. 15, 1993

[30] Foreign Application Priority Data

Oct. 11, 1991 [FR] France ..... 91 12711

[51] Int. Cl.[6] ..... F01D 1/02; F01D 15/06; F01D 17/00

[52] U.S. Cl. ..... 415/1; 415/36; 415/37; 415/42; 415/46; 415/116; 415/149.2; 415/150; 415/167; 415/181; 415/202; 415/904; 416/223 A; 416/197 R; 416/243

[58] Field of Search ..... 415/1, 26, 29, 415/30, 35, 36, 37, 42, 46, 116, 117, 149.1, 149.2, 150, 167, 181, 185, 202, 220, 222, 904, 191, 208.1, 208.2, 211.2; 416/223 A, 243, 197 R, 197 B

[56] References Cited

U.S. PATENT DOCUMENTS

| | | | |
|---|---|---|---|
| 392,730 | 11/1888 | Howard | 415/167 |
| 3,173,604 | 3/1965 | Sheets et al. | 415/220 |
| 3,972,196 | 8/1976 | Silvestri, Jr. . | |
| 4,367,626 | 1/1983 | Schwartzman . | |
| 4,566,844 | 1/1986 | Flink | 415/904 |
| 5,161,946 | 11/1992 | Bortz et al. | 415/191 |
| 5,275,528 | 1/1994 | Freeman et al. | 415/26 |

FOREIGN PATENT DOCUMENTS

| | | | |
|---|---|---|---|
| 0553353 | 2/1958 | Canada | 415/202 |
| 522163 | 7/1921 | France . | |
| 0421793 | 12/1934 | United Kingdom | 416/243 |
| 0922090 | 3/1963 | United Kingdom | 416/223 A |
| 1410543 | 10/1975 | United Kingdom . | |
| 1435300 | 5/1976 | United Kingdom | 415/30 |

*Primary Examiner*—Edward K. Look
*Assistant Examiner*—Christopher Verdier
*Attorney, Agent, or Firm*—Graham & James

[57] ABSTRACT

A turbine device and a method of driving the turbine device are disclosed. The turbine device includes an admission channel, a turbine, and an injection channel. The turbine device may also include a regulator. The turbine is driven by injecting a primary fluid into the admission channel at a given velocity and simultaneously causing a secondary fluid to flow into the admission channel at a lower velocity. The primary fluid and the secondary fluid form a mixture in the admission channel, which flows toward the turbine. The velocity of the mixture is less than that of the primary fluid, while the mass flow of the mixture is approximately equal to the sum of the mass flows of the primary and secondary fluids. The regulator compares the rotational speed of the turbine to a target speed and regulates parameters associated with the turbine device if the rotational speed of the turbine and the target speed differ by more than a predetermined amount.

26 Claims, 4 Drawing Sheets

FIG. 4
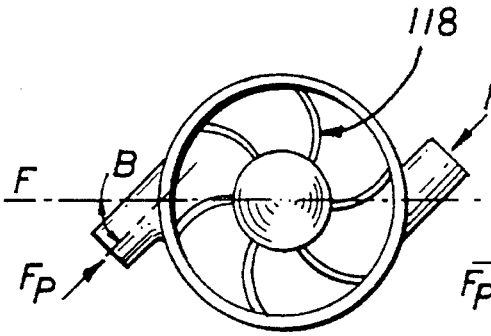
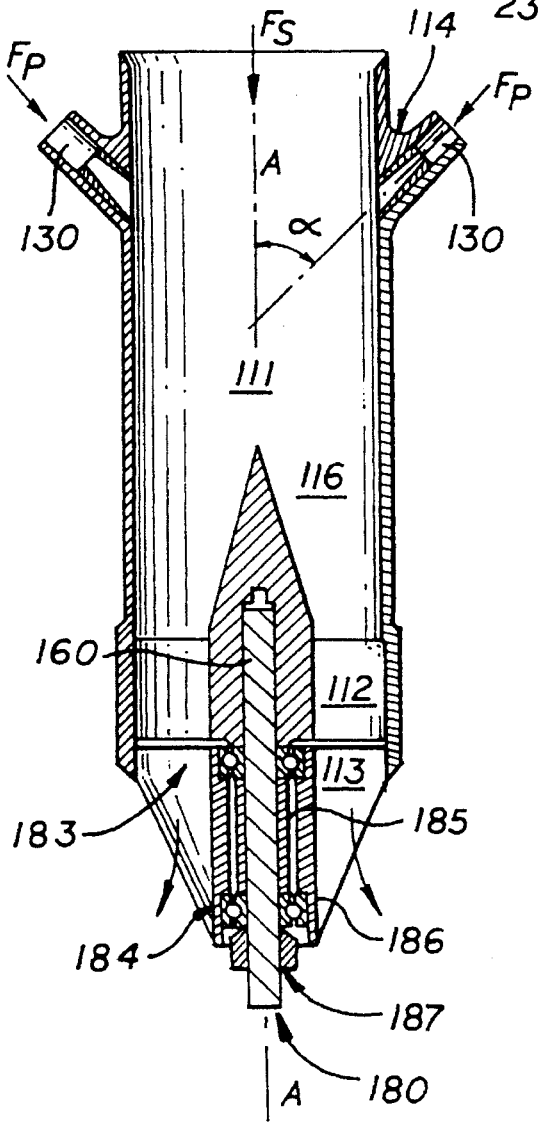
FIG. 3
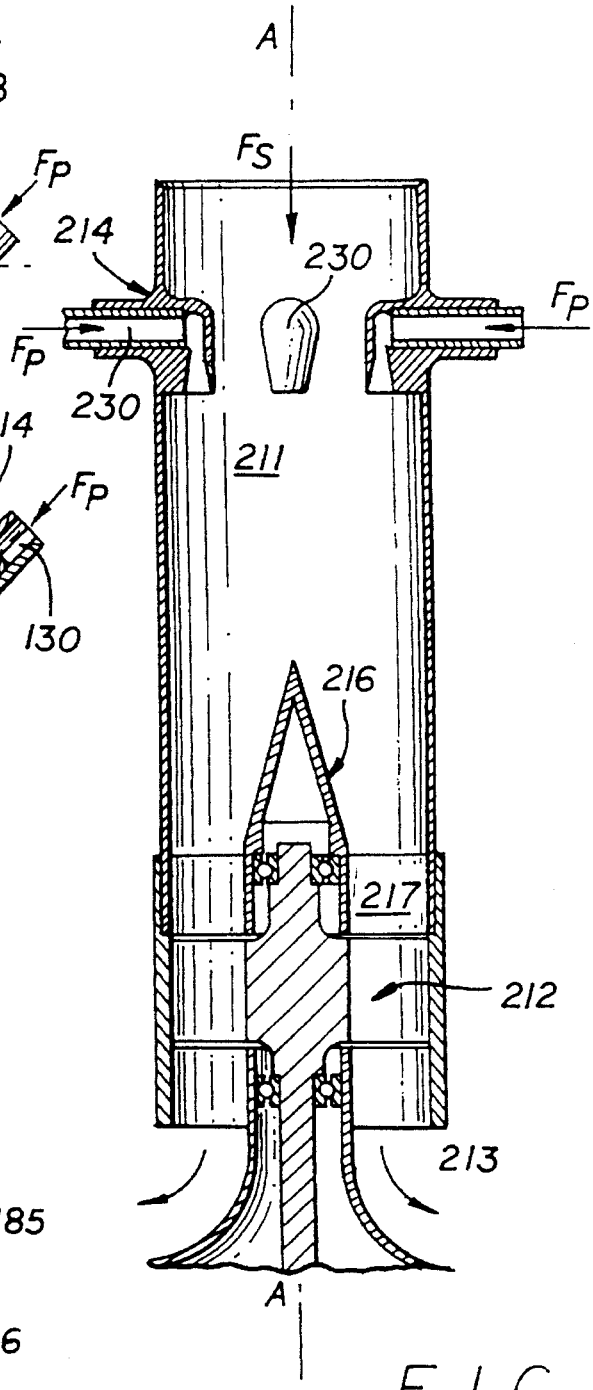
FIG. 5

FIG. 7
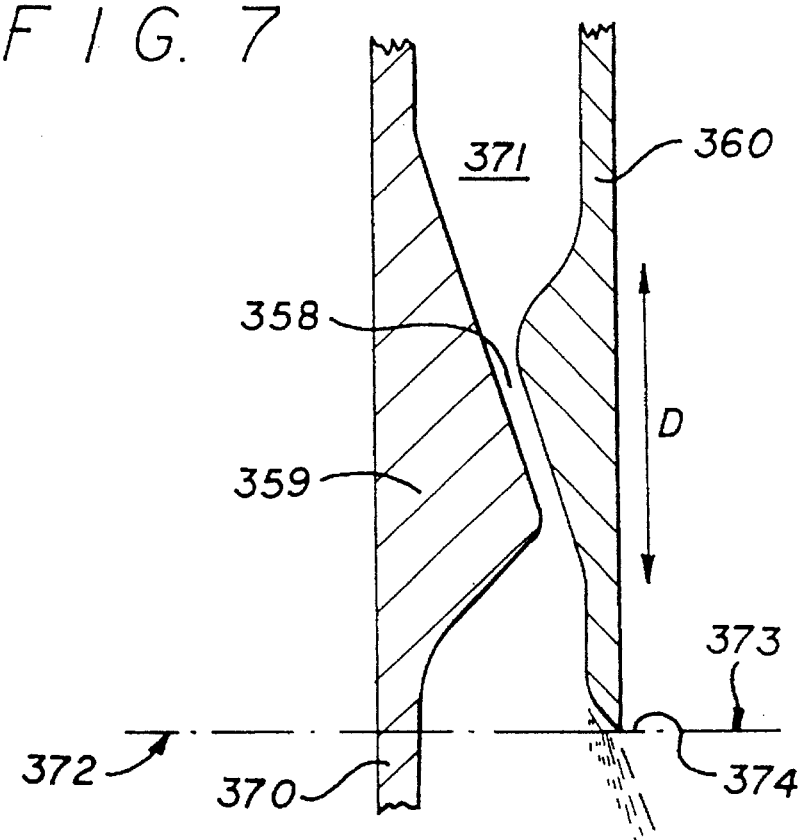
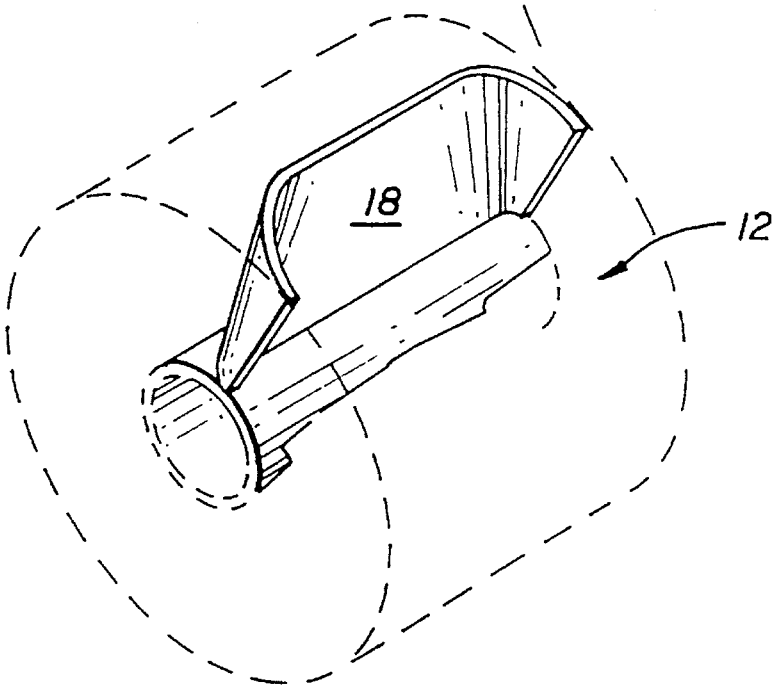
FIG. 8

METHOD OF DRIVING A TURBINE IN ROTATION BY MEANS OF A JET DEVICE

The present invention relates to a method of driving a turbine in rotation and to a corresponding turbine device.

Turbines have been known for a long time and are essentially constituted by a hub bearing blades, driven in rotation by a fluid (gas, liquid) passing therethrough.

In known manner, drive of a turbine by a fluid makes it possible to transfer the energy of the fluid to the rotation shaft of the turbine. For example, rotation of this shaft serves to drive an alternator to produce electric current, or to drive various tools (drilling, sawing , . . . ).

Up to the present time, the problems of the known devices reside in high flow velocities necessary for obtaining the highest powers possible. However, such high flow velocities lead to considerable disturbances; for example, when the fluid is a gas, there is creation:

of shock waves, of expansion or compression beams appearing on the various components of the device.

The consequences of such disturbances are, inter alia, that:

the components of these devices must present particular, precise, optimum shapes (which involves a limited, and even very limited domain of use), said components must mechanically withstand the efforts induced by the vibratory phenomena accompanying these disturbances, said disturbances create acoustic phenomena which are often very violent.

Another aspect limiting the use of the prior turbine devices resides in the high, even very high speeds of rotation of these devices.

It is an object of the present invention to overcome all these drawbacks and in particular to create a turbine of which the nominal working point is not associated with a transonic flow velocity in order to avoid all the problems associated with the disturbances induced by such a flow.

It will be recalled that a working point is characterized by a torque of value (speed of rotation, power) or (speed of rotation, torque). In the present description, nominal working point will mean a working point corresponding to a maximum power. Nominal torque working point will mean the working point corresponding to a maximum torque.

One of the purposes of the invention is to obtain powers comparable to those obtained on conventional turbines, but with flow velocities compatible with flows which are not or only slightly disturbed.

To that end, the present invention concerns a method of driving a turbine in rotation, said turbine being connected to an upstream fluid admission channel and to a downstream ejection channel, said process being characterized in that it consists in:

injecting a primary fluid in the fluid admission channel, said primary fluid presenting a determined pressure Pp, velocity Vp and mass flow dmp, simultaneously admitting a secondary fluid in the fluid admission channel, this fluid presenting a pressure ps and a velocity vs less than those of the primary fluid, and a mass flow Dms, mixing the primary and secondary fluids in the admission channel and directing the mixture of the fluids towards the turbine, this mixture presenting a mass flow equal to the sum of the mass flows of the primary and secondary fluids (dmp+Dms), driving the turbine in rotation by the passage of the mixture of fluid over blades of this turbine and ejecting the mixture of fluid by means of the fluid ejection channel.

Advantageously, the method according to the invention is a method of driving a turbine in rotation at a variable reference speed of rotation and consists in addition in:

continuously measuring a magnitude representative of the real speed of rotation of the turbine, comparing this real speed of rotation with the reference speed of rotation, continuously modifying one or more parameters of the flow for the nominal working point of the turbine to correspond to the reference working point.

Thus, the fact of injecting a primary fluid at pressure and velocity higher than the secondary fluid entrains the latter towards the turbine. This effect is known under the name of Venturi effect or jet pump effect. However, this effect is used in the present invention as energy transformer and speed reducer. In fact, the Venturi effect, in the present case, transforms the energy of the primary fluid injected via a nozzle with low mass flow and high velocity and pressure, into the energy of a fluid (resulting from the mixture of said primary fluid with the secondary fluid sucked by Venturi effect), characterized by a high mass flow and a low flow velocity.

Now, in known manner, the power available on the rotation shaft of the turbine is: $P=C.\omega$ . where C is the torque delivered and $\omega$ the speed of rotation of the turbine. The torque is expressed by: $C=F.d$ where F is the overall radial force resulting from the flow of the fluid in inter-blade channels of the turbine and where d is the distance from the point of application of this force to the shaft of the turbine.

Moreover, if it is question of a gaseous flow, in first approximation, the force F is expressed by the following formula:

$$F=Dmm\ (We \sin(\beta e)-Ws \sin(\beta s))$$

where

Dmm is the mass flow of the fluid traversing the turbine (i.e. of the mixture of fluid), $\beta e$ is the leading angle of the blades of the turbine, $\beta s$ is the trailing edge angle of the blades of the turbine, We is the module of the relative velocity (reference rotating with the turbine) of admission of the fluid in the turbine, Ws is the module of the relative outlet velocity of the fluid in the turbine.

For a given nominal working point, therefore characterized by a given power and speed of rotation ($\omega$), a torque (C), and therefore a force (F), is sought. This force F is obtained by producing a high mass flow Dmm equal to the sum of the mass flows dmp+ Dms whilst having fluid flow velocities We and Ws sufficiently low to be compatible with a slightly disturbed flow.

In addition, the method according to the invention makes it possible, by continuously acting on the pressure and/or the velocity of the primary fluid and/or on any other dimensional or functional parameter of the turbine device, to be able to adapt the nominal working point of the device to the reference working point.

The real speed of rotation is continuously measured then compared with a reference speed of rotation. This reference speed of rotation is determined for a given application. For example, if the turbine drives a milling tool, this speed may be of 36000 rpm.

Further to this comparison, one or more dimensional or functional parameters are continuously modified so that the speed of rotation measured is equal to the reference speed of rotation.

Advantageously, in order to modify the dimensional parameters, the secondary fluid admission, primary fluid injection and fluid ejection channel outlet sections are continuously modified so as to render equal, as much as possible, the reference working point and the nominal working point.

Advantageously, in order to modify the functional parameters, in addition to the variation in pressure of the primary fluid, the injection of the primary fluid may be effected along a helicoidal path inducing a self-limitation and self-adaptation of the working conditions of the turbine. Such a mode of injection is called helicoidal.

Similarly, the injection of the primary fluid is advantageously effected in zones close to the walls of said admission channel. Such a mode of injection is called peripheral.

The present invention also relates to a turbine device employing the method described hereinabove, said device comprising, within a body presenting overall a symmetry of revolution, an upstream fluid admission channel, a turbine and a downstream fluid ejection channel, said device being characterized in that it further comprises:

means for injecting a primary fluid in the fluid admission channel, said primary fluid presenting determined pressure, velocity and mass flow, means for admitting a secondary fluid in the fluid admission channel, this secondary fluid presenting pressure and velocity less than those of the primary fluid and a mass flow, means for mixing the primary and secondary fluids adapted to give the mixed fluids a mass flow equal to the sum of the mass flows of the primary and secondary fluids and to direct this mixture towards the turbine and thus drive this turbine in rotation.

The device is advantageously adapted to drive a turbine in rotation at a variable reference speed and comprises to that end control and regulation means (50) comprising:

means for measuring a magnitude representative of the speed of rotation of the turbine, means for acquiring the measured speed of rotation, processing means adapted to compare the measured speed of rotation with a reference speed of rotation, actuators adapted to regulate functional and/or dimensional parameters of the flow to cause the measured value of the speed of rotation to coincide with the reference value of this speed, and a stop valve.

Thanks to such arrangements, a nominal working point of the turbine is obtained for a high torque and a low speed of rotation compared to that obtained without using such arrangements on a comparable turbine.

The device according to the invention is advantageously provided with actuators adapted to vary the section of admission of the primary and secondary fluids, as well as the section of the ejection channel. The nominal working point of the turbine may thus be modified as desired and continuously adapted to the reference working point.

Other objects, characteristics or advantages of the invention will appear from the following description, by way of example and with reference to the accompanying Figures in which:

FIGS. 3 and 4 are views, in longitudinal section and from above, respectively, of a first variant embodiment of a device according to the invention.

FIG. 5 is a view in longitudinal section of a second variant embodiment of the device according to the invention.

FIG. 7 is an enlargement of the detail referenced E in FIG. 6, and

FIG. 8 is a schematic view in perspective showing a blade mounted on a hub, and intended to form a turbine which may be used for the device according to the invention.

As already indicated, the purpose of the present invention is to drive a turbine in rotation, and this at a relatively low speed of rotation $\omega$, of the order of 0 to 60000 rpm, but with a high torque C. Thus, the product $C.\omega$ which gives the power P of the turbine remains high, without the speed of rotation $\omega$ being so.

To that end, the method according to the invention of driving the turbine is described hereinafter.

The turbine being placed between an upstream fluid admission channel and a downstream ejection channel, the method according to the invention consists in:

injecting a primary fluid in the upstream fluid admission channel. Such injection is effected at determined pressure Pp, velocity Vp and mass flow dmp, admitting a secondary fluid in the upstream admission channel. The pressure ps and velocity vs of this secondary fluid are less than those of the primary fluid. The mass flow of this secondary fluid is dms, mixing in the admission channel the primary and secondary fluids. The mixture thus obtained presents a velocity Vm and a pressure Pm higher than those of the secondary fluid, and less than those of the primary fluid. The mass flow Dmm of this mixture of fluid is equal to the sum of the mass flows dmp+ Dms of the primary and secondary fluids, directing the mixture of fluids towards the turbine, driving the turbine in rotation by the passage of the mixture of fluid, and ejecting the mixture of fluid having traversed the turbine, towards the outside.

Advantageously, the method makes it possible to drive a turbine in rotation in accordance with a variable reference parameter and consists, in addition, in:

continuously measuring a parameter as a function of the speed of rotation of the turbine, comparing this measured speed of rotation with a reference speed. This measured speed of rotation is a function, inter alia, of the dimensional and functional parameters of the flow, continuously modifying one or more parameters of the flow in order to adapt the nominal working point of the turbine to the reference working point.

Advantageously, a modification is made of the dimensional parameters of the turbine device (variation of the inlet section of the secondary fluid, of the injection section of the primary fluid and of the ejection section of the ejection channel). Consequently, the nominal working point of the turbine is modified and the real speed of rotation is continuously regulated so that it corresponds to the reference speed of rotation.

The turbine device according to the invention is described hereinafter.

Figure 1:
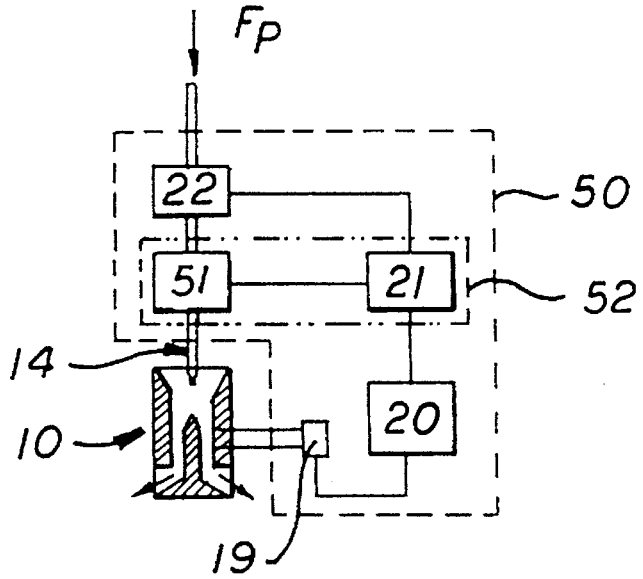
FIG. 1 shows a sectional view of a turbine device and a schematic view of a control and regulation device.
Figure 2:
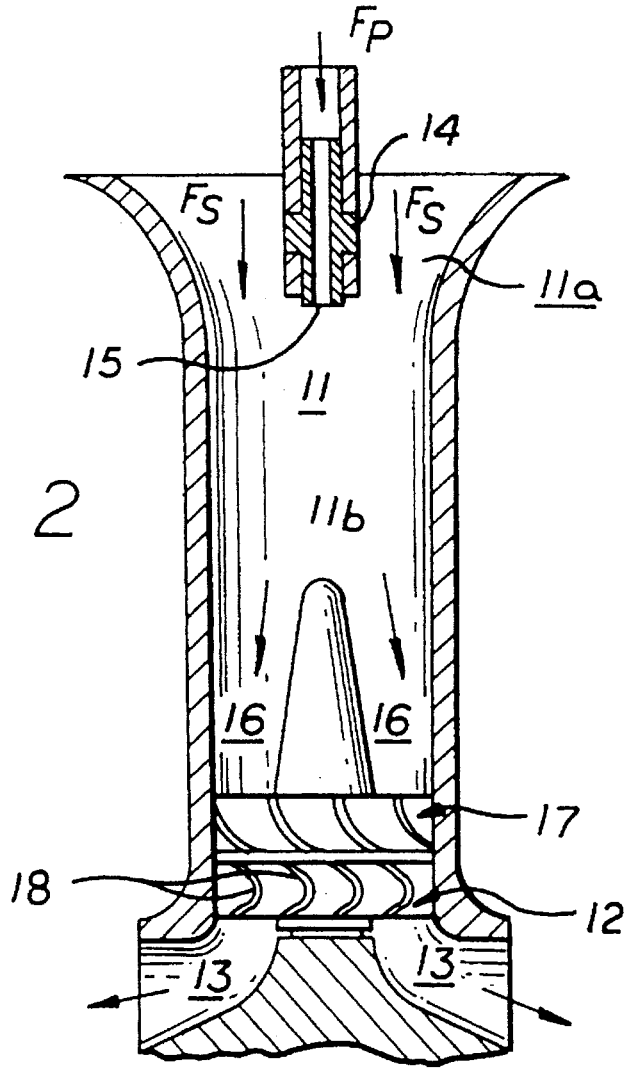
FIG. 2 is a view in longitudinal section of a turbine device according to the present invention.

According to the embodiment shown in FIGS. 1 and 2, the device 10 according to the invention essentially comprises (FIG. 2):

an upstream fluid admission channel 11, a turbine 12, a downstream fluid ejection channel 13, injection means 14, and control and regulation means 50 (FIG. 1). These means 50 are constituted by:

a stop valve 22, measuring means 19, acquisition means 20, and regulation means 52 comprising:
processing means 21, and
actuators 51.

The means 14 (FIG. 1) for injection of primary fluid Fp in the admission channel 11 is placed in the upstream part 11*a* of the admission channel 11. This means 14 comprises a nozzle 15.

A secondary fluid Fs is sucked in the upstream admission channel by the depression created by the injection of the primary fluid. Once in the upstream admission channel, these two fluids are mixed in the downstream part 11*b* of the admission channel 11. The length of this admission channel determines in part the characteristics of the mixture of the fluids.

If necessary, a convergent channel 16 is placed upstream of the turbine 12 and has for its purpose to accelerate the mixture of fluids.

A deflector means 17, called upstream distributor, constituted by a fixed turbine wheel, is placed upstream of the turbine 12 in order to direct the mixture of fluids in optimum manner over blades 18 of the turbine 12.

The turbine 12 is thus driven in rotation.

The mixture of fluids is then ejected via the ejection channel 13 out of the turbine device. The purpose of such a channel is to adapt in particular the pressure of the fluid leaving the turbine to that of the fluid present around the ejection section.

The rotation of the turbine is employed for any application, for example for driving tools, etc., as will be detailed with reference to FIG. 3.

The turbine device is in addition associated with control and regulation means 50. These means 50 comprise:

means 19 for measuring a magnitude representative of the speed of rotation of the turbine 12. These measuring means are constituted by two piezoelectric sensors (only one is shown in FIG. 1) measuring the static pressures upstream and downstream of the turbine in non-disturbed flow zones. The purpose of the presence of these two sensors is to multiply the points of measurement in order to compare their value and to activate, if necessary, a stop valve 22 installed on the primary fluid supply pipe. These means must be reliable and give repetitive and significant measurements.

acquisition means 20 receiving and adapting the electrical magnitudes measured by means 19, processing means 21 adapted to define the instantaneous speed of rotation of the turbine (measured speed), and to compare this measured speed of rotation with a reference speed of rotation. If the measured and reference speeds differ, the processing means sends a command order, actuators 51 here constituted by a pressure regulator receiving the command order from the processing means and adapted to modify the pressure of injection of the primary fluid and to render the measured and reference speeds of rotation equal, and a safety stop valve 22 placed upstream of the primary fluid injection device in order to stop functioning of the device if necessary. This stop valve is also controlled by the processing means 21.

In this way, the device according to the invention is continuously regulated by the control and regulation assembly 50.

In a variant of this device, the convergent channel 16 may be integrated in the upstream distributor 17.

As shown in FIGS. 3 and 4, the injection means 14 may take different shapes.

In the examples shown in FIGS. 3 and 4, the means corresponding to those described in FIG. 2 are referenced as in FIG. 2, but increased by a unit of one hundred.

FIGS. 3 and 4 present a first variant of the device according to the invention.

The injection means 114 are constituted by two conduits 130 opening in the lateral wall of the upstream admission channel 111. Advantageously, these conduits are inclined by an angle $\propto$ (FIG. 3) determined with respect to axis A of the device, and an angle $\beta$ (FIG. 4) between the axis of the conduit 130 and a diametral plane F passing through the axis of the turbine and the centre of the injection section at the level of the wall of the channel 111.

Thus, the primary fluid Fp entrains the secondary fluid Fs in a helicoidal path (helicoidal injection) along the walls (peripheral injection) of the upstream admission channel 111. This type of injection is called peripheral-helicoidal injection.

This mode of injection presents the advantage of being self-adapting. In fact, when the speed of rotation of the turbine increases, the mass flow Dms of the secondary fluid also increases. The speed of the secondary fluid in the plane of injection of the primary fluid in the admission channel, has a modulus which increases and a direction which tends to approach the turbine shaft. Consequently, the flow of the mixture presents a general incidence which decreases in the admission plane of the turbine. Consequently, the available power tends to decrease if the increase off the secondary mass flow is not taken into account and vice versa if the speed of rotation of the turbine decreases. This then results in a turbine device of which the free rotation conditions (i.e. without resistant torque generated by the outside medium on the shaft of the turbine) are self-limited, and which present a high power peak for a low speed of rotation, characterizing the phenomenon of self-adaptation of the flow.

By way of example, the speed of rotation corresponding to such a power peak is 12000 rpm for a turbine with a diameter of 30 mm and a primary fluid supply of peripheral-helicoidal type with three admission ways equally distributed along the circumference of the admission channel (angles $\propto$ and $\beta$ of inclination of the admission conduits being 45°).

It should be noted that the number of primary fluid injection conduits 130 may vary. For a better homogeneity of the primary fluid/secondary fluid mixture, it is advantageous to have available a plurality of injection conduits distributed on the circumference of the admission channel.

It will be noted that, in the embodiment presented in FIGS. 3 and 4, the ejection channel 113 presents an axial direction. It will also be noted that, with such a mode of injection (peripheral-helicoidal), it is not necessary to place a deflector device upstream of the turbine 112.

According to a variant embodiment (not shown) (angle ∝ fixing the initial slope of the injection helix, angle β defining the nominal diameter of the injection of this helix), the following are continuously varied:

angle ∝, which has for its purpose to vary the nominal speed of the nominal working point and/or angle β, which has for its purpose to modify the working characteristics, with priority in secondary mass flow, therefore the maximum power at the nominal working point.

It will be noted that the rotation shaft of the turbine may be directly constituted by a mandrel rod 160 of a tool 180.

Transmission of the motive force from a turbine to a tool raises problems of technical implementation such as:

efforts proportional to the inertia of the transmission members and to the square of the speed of rotation and the necessity of employing a transmission whose geometry may vary by the relative mobility of a certain number of constituent parts in order in particular to be able to fix the tool on the transmission.

However, in the case of the tool-turbine assembly shown in FIG. 3 and, taking into account the moderate speeds of rotation of the device, it is possible to use simple bearings for guiding in rotation and translation, which are rustic and inexpensive, currently used at the present time in the industry.

In the example of such an embodiment, the turbine 112 is force-fitted on the rear part 160 (mandrel rod) of the cylindrical tool 180 which may be a mill.

The tool may present, to that end, at the level of its mandrel rod, an assembly of small rectilinear edges oriented along the axis of rotation of said tool.

In a variant, the tool may be associated with an intermediate fixation piece (not shown).

In the example shown, the suspension bearing of the tool-turbine assembly is constituted by roller bearings 183 and 184. Roller bearing 183 abuts on the hub of the turbine. A spacer 185, suitably mounted to slide on said tool, maintains the spaced apart relationship with roller bearing 184 so as to ensure the necessary functional clearance along the axis of rotation at the level of the bearing body 186.

A ring 187, made of a material whose coefficient of heat expansion is less than that of the material constituting said tool, is mounted tightened on said tool and immobilizes rollers 183 and 184 and the spacer 185 in translation (along the axis of rotation of the tool).

The assembly thus produced is constituted by a small number of parts which are simple, inexpensive and of low inertia around the axis of rotation.

According to the embodiment shown in FIG. 5 (second variant), the mode of injection of the primary fluid is different again.

As before, the references of FIG. 2 have been employed in this Figure, increased by two units of hundred.

The injection means 214 is here constituted by four conduits 230 (three are shown) opening inside the admission channel 211, so that the primary fluid Fp is injected parallel to the axis A of the device and along the walls. Such a mode of injection is called peripheral.

As in the example of FIG. 2, the primary fluid entrains the secondary fluid towards the turbine.

It will be noted that the number of primary fluid introduction conduits 230 may vary and that the plurality of conduits is preferably distributed along the circumference of the admission channel 211.

In a variant, each conduit 230 may pivot about its horizontal axis to generate a flow which is no longer axial but helicoidal. In this case, a helicoidal-peripheral flow is obtained with the advantages mentioned with reference to FIGS. 3 and 4, and associated with an upstream distributor 217.

Figure 6:
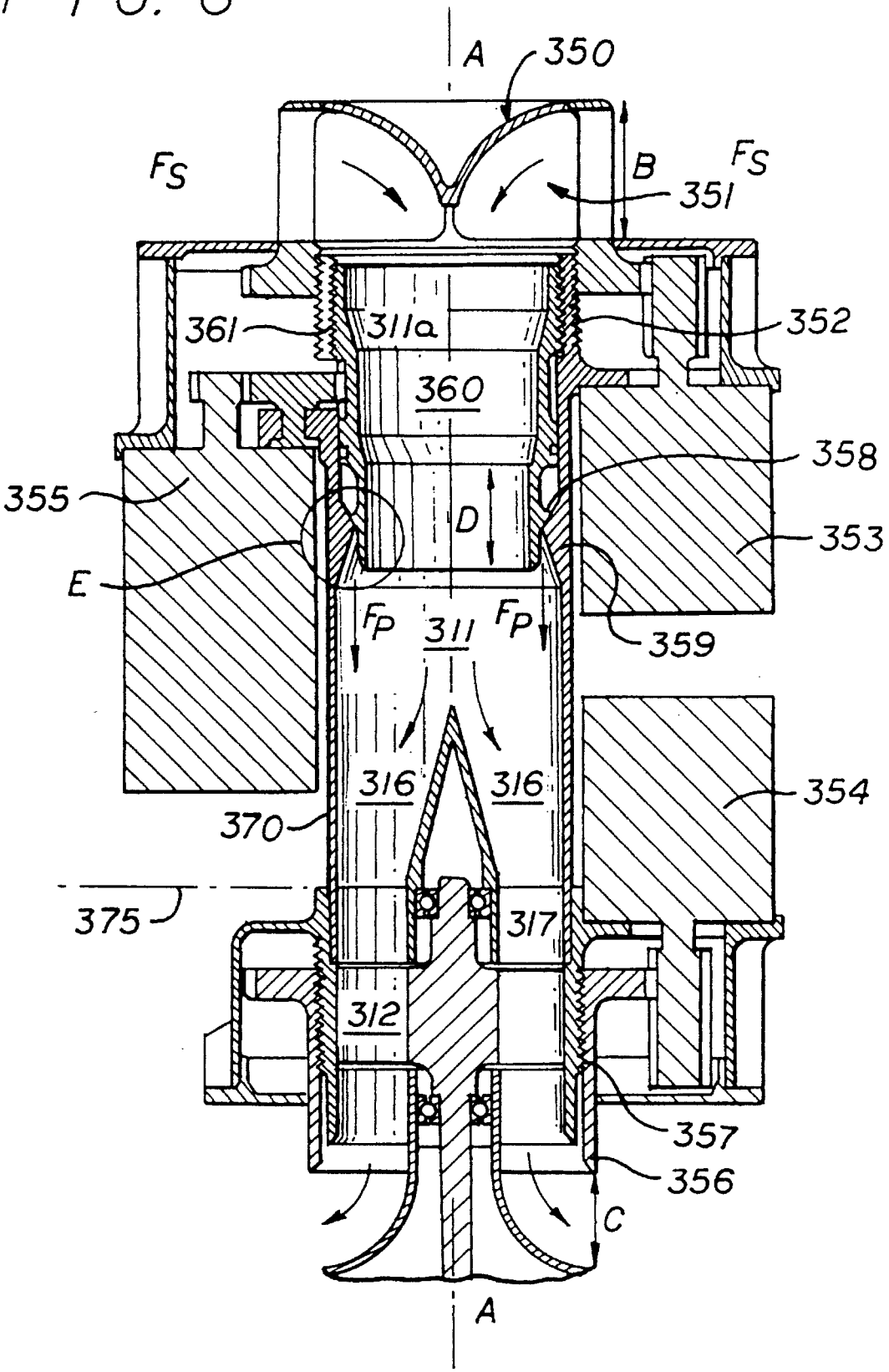
FIG. 6 is a view in longitudinal section of a third variant embodiment of the device according to the invention.

FIGS. 6 and 7 show a third variant embodiment of the turbine device according to the invention. As before, the references of FIG. 2 are employed, increased by three units of hundred for the equivalent means shown in FIGS. 2 and 6.

The device 310 according to FIG. 6 presents the particularity of having:

a primary air injection of annular type and at the level of the walls (peripheral-annular injection), actuators adapted to vary the inlet section of the secondary fluid, the injection section of the primary fluid and the ejection section of the ejection channel.

In fact, the secondary fluid is introduced in the admission channel via an inlet device 350 presenting an opening 351 of variable section. The inlet device is screwed and unscrewed on the body of the admission channel 311 via a thread 352.

Such screwing (or unscrewing) is controlled by a means for modifying the inlet section, namely the actuator 353. This actuator 353 is itself controlled by the processing means 321. As shown by arrow B, the action of this actuator 353 enables the inlet section of the secondary fluid to be varied.

Correspondingly, an actuator 354 for varying the ejection section of the device allows screwing or unscrewing of an outlet device 356 via a thread 357. As shown by arrow C, the action of this actuator 354 enables the ejection section to be varied.

In the same manner as before, the actuator 354 is controlled by the processing means 321.

An actuator 355 making it possible to vary the primary fluid injection section in the admission channel 311 is also provided.

The primary fluid Fp is introduced in the admission channel 311, passing through a minimum section 358 called neck section of the flow, this section varying by means of the actuator 355.

This neck is created (FIG. 7), on the one hand, by an annular swell 359 of the wall of the admission channel 311 and, on the other hand, by a displaceable element 360 placed in the upstream part 311*a* of the admission channel 311 and opposite the annular swell 359.

By sliding element 360 in the direction of arrow D, the section of the primary fluid supply neck 358 is variable. Slide is effected by screwing and unscrewing the displaceable element 360 in the admission channel 311 by means of the thread 361.

It will be noted that introduction of the primacy fluid Fp in the admission channel 311 is effected in manner parallel to the longitudinal axis A of the device. Such injection is effected over the whole periphery of the admission channel and in the vicinity of the walls. Such injection is called peripheral-annular injection.

As shown in FIG. 7, the respective shapes of the body 370 of the admission channel 311 and of the displaceable element 360 which faces it constitute an annular convergent-divergent nozzle. Said annular convergent-divergent nozzle, supplied with primary fluid by an annular section 371, therefore has a neck 358 and an outlet section 372 of which the respective surfaces may vary when the actuator 355 drives element 360 in translation. In the convergent part of said nozzle, the primary fluid undergoes a subsonic acceleration until it reaches sonic velocity at said neck 358. In the divergent part of said nozzle, the primary fluid undergoes a supersonic acceleration. In operation, the primary fluid supply pressure must be sufficient in order that, taking into account the value of the surface of the injection section 372, the ejection of said primary fluid in the admission channel be supersonic and at a static pressure higher than that of said secondary fluid in section 373 of element 360. In fact, there is then created on outlet lips 374 of element 360 an expansion beam and a turbulent slipstream adapted to promote exchange of energy between said primary and secondary fluids. Moreover, the peripheral injection in an annular convergent-divergent nozzle makes it possible, on the one hand, to increase the energetic exchange surface between said primary and secondary fluids and, on the other hand, to obtain in the inlet plane 375 (FIG. 6) of said distributor 317 an optimum velocity profile characterized in that the local mean velocity is all the greater as it is located near the head of the blades 18 of said distributor 317.

Such a dimensional and functional arrangement of a convergent-divergent nozzle at the level of the injection of the primary fluid may be generalized for all primary fluid injections, whatever the variant embodiment considered.

Such a device makes it possible, by acting on the dimensions of the primary and secondary fluid admission channels and on the dimension of the ejection channel, to vary the nominal working point of the turbine.

Of course, the assembly of actuators 353, 354, 355 is controlled by the processing means 321.

Another variant embodiment of the ejection device consists in producing an ejection channel from the conduit conducting the fluid from the outlet plane of the turbine towards the level of the admission of the secondary fluid and thus making it possible to recycle in the device itself part of the ejected fluid.

The interest of the device according to the invention, whatever the variant embodiment chosen, resides in the fact that the torque delivered is high for low speeds of rotation and that the power delivered is comparable to that of existing turbines.

Blades which may be used in each of the variant embodiments described hereinabove will now be described.

However, to facilitate understanding of this description, the definitions of the principal terms used will be recalled:

The leading edge of a blade is the portion of curve located at the upstream end of said blade and which receives the flow.

The trailing edge of a blade is the portion of curve located at the downstream end of said blade and from which the flow escapes.

A blade is constituted by a so-called undersurface and a so-called upper surface; these two surfaces are secant along the trailing edge and leading edge lines.

An airfoil of a blade is the closed curve resulting from the intersection of the under- and upper surfaces with a cylindrical surface having for axis that of the hub bearing the blade.

The chord of an airfoil is the segment of straight line joining on a blade airfoil the points of the trailing edge and of the leading edge.

A leading edge angle is the angle made by a straight line tangential to the airfoil at the point of the leading edge with the direction of the axis of said hub.

A trailing edge angle is the angle made by a straight line tangential to the airfoil at the point of the trailing edge with the direction of the axis of the hub.

The thickness of an airfoil at a given point of the undersurface is the length of the segment of straight line defined by said point of the undersurface and the point of the upper surface defined by the intersection of the upper surface with a straight line perpendicular to the undersurface at said point of the undersurface.

The root of a blade is the part off the blade adjacent the hub.

The head of a blade is the Dart of the blade most remote from the hub.

The blades are described with reference to FIG. 2, but may equally well be used with the variant embodiments shown in FIGS. 3 to 6.

The turbine 12 (FIG. 8) is constituted by a cylindrical hub on which are radially disposed blades 18 equally distributed in a circle. These blades are identical for the same turbine. The leading edge angles are constant all along the leading edge for all the blades of the same turbine, in the same way as for the trailing edge angles. The chord of the airfoils is constant for all the airfoils of all the blades of the same turbine. The thickness of an airfoil is constant, apart from in the immediate vicinity of the trailing edge and of the leading edge.

In a variant, the thickness of the airfoils of a blade increases from the head to the root of the blade in order to take into account the mechanical stresses increasing from the head to the root of the blade.

It will thus be noted that the blades present a constant chord, a constant thickness along a cylindrical section having for axis that of said turbine, constant leading edge angles, and constant trailing edge angles. It will also be noted that the curved under- and upper surfaces of the blades are generated by a conical surface whose apex is the point of intersection of the axis of said turbine with the planes, perpendicular to the axis of said turbine, inlet for the upstream part and outlet for the downstream part, and whose apex angle is a function of the leading edge angle for the upstream part and of the trailing edge angle for the downstream part.

Such blades are simple to produce (machining, moulding, etc. . . . ) and are inexpensive.

in addition, such blades present the advantage, when the speed of the turbine increases, of likewise increasing the velocity of the flow in the inter-blade channel. From a certain value of said flow velocity, expansions and recompressions substantially degrade the flow in the inter-blade channel. This results in a phenomenon of self-limitation of the free operating speed.

It will be noted that, thanks to the relatively low speeds of rotation (from 0 to 60000 rpm) simple, current turbine suspension bearings may be used.

One of the advantages of the present invention is its lightness, its silence in operation, its reliability. In addition, simple, inexpensive transmissions existing on the market may easily be adapted on such a turbine to drive tools between 0 and 60000 rpm.

The present invention is, of course, not limited to the embodiments chosen and covers any variant within the scope of the man skilled in the art. In particular, it is possible, in a variant, to produce, at the level of the ejection planes of the device, a pressure lower than the general level of pressure prevailing in the environment outside the device. In that case, the nominal power level of the device does not vary substantially; on the contrary, the mass flow injected decreases substantially, this phenomenon characterizing the introduction of a second source of energy materialized by the depression at the outlet of the ejection channel, to the detriment of the source of energy defined by the primary fluid under pressure; however, the precision of the control of the speed of rotation of the turbine by acting on the primary fluid injection pressure Pp decreases.

What is claimed is:

1. A method of driving a turbine that is disposed between an admission channel and an ejection channel, said method comprising:

generating a flow of a secondary fluid having a secondary mass flow into said admission channel at a secondary velocity;

injecting a primary fluid having a primary mass flow into said admission channel at a primary velocity, said primary velocity being greater than said secondary velocity, said injecting step occurring substantially simultaneously with said generating step so as to create within said admission channel a mixture of said primary fluid and said secondary fluid, said mixture having a mass flow substantially equal to a sum of said primary mass flow and said secondary mass flow and a velocity toward said turbine that is less than said primary velocity;

passing said mixture over blades of said turbine;

substantially adapting a pressure of said mixture to an ambient pressure outside of said ejection channel; and ejecting said mixture via said ejection channel.

2. The method of claim 1 further comprising the steps of:

measuring a speed of rotation of said turbine, comparing said measured speed of rotation of said turbine with a reference speed of rotation, modifying at least one parameter associated with said method of driving said turbine if said measured speed of rotation of said turbine and said reference speed of rotation differ by a predetermined amount.

3. The method of claim 2, wherein said at least one parameter modified at said modifying step is selected from a group comprising:

a parameter associated with said step of generating said flow of said secondary fluid, a parameter associated with said step of injecting said primary fluid, a parameter associated with said ejection channel, and a parameter associated with a pressure of said primary fluid injected into said admission channel.

4. The method of claim 1, wherein said injecting step further comprises the step of injecting said primary fluid into said admission channel in a peripheral manner.

5. The method of claim 1, wherein said injecting step further comprises the step of injecting said primary fluid into said admission channel in a peripheral manner and said generating step further includes the step of generating said flow of said secondary fluid into said admission channel in an axial direction with respect to said admission channel.

6. The method of claim 1, wherein said injecting step further comprises the step of injecting said primary fluid into said admission channel in such a manner that said mixture of said primary and secondary fluids is entrained in a helicoidal movement.

7. The method of claim 6, wherein said helicoidal movement is peripheral.

8. The method of claim 1, wherein said injecting step further comprises the step of injecting said primary fluid into said admission channel in an annular manner.

9. A method of driving a turbine that is disposed between an admission channel and an ejection channel, said method comprising:

generating a flow of a secondary fluid having a secondary mass flow into said admission channel at a secondary velocity;

injecting a primary fluid having a primary mass flow into said admission channel at a primary velocity, said primary velocity being greater than said secondary velocity, said injecting step occurring substantially simultaneously with said generating step so as to create within said admission channel a mixture of said primary fluid and said secondary fluid, said mixture having a mass flow substantially equal to a sum of said primary mass flow and said secondary mass flow and a velocity toward said turbine that is less than said primary velocity;

passing said mixture through blades of said turbine;

substantially adapting a pressure of said mixture to an ambient pressure outside of said ejection channel; and ejecting said mixture via said ejection channel, wherein a velocity of said primary fluid is supersonic before said primary fluid is injected into said admission channel.

10. The method of claim 9, wherein expansion waves created by said supersonic velocity of said primary fluid aid in said mixing of said primary fluid and said secondary fluid.

11. The method of claim 2, wherein said injecting step further comprises the step of injecting said primary fluid into said admission channel in an injection helix, and wherein said at least one parameter modified at said modifying step is selected from a group comprising:

a first angle defining a slope of said injection helix, and a second angle defining a diameter of said injection helix.

12. The method of claim 2, wherein said step of measuring said speed of rotation of said turbine further includes the steps of measuring a static pressure upstream and downstream of said turbine.

13. The method of claim 1, further including the step of passing said mixture of said primary fluid and said secondary fluid through a convergent channel upstream from said turbine.

14. A turbine device comprising:

a body having a symmetry of revolution and comprising an admission channel and an ejection channel;

a turbine disposed between said admission channel and said ejection channel;

injection means for injecting a primary fluid having a primary mass flow into said admission channel at a primary velocity;

inlet means for generating a flow of a secondary fluid having a secondary a mass flow into said admission channel at a secondary velocity, said secondary velocity being less than said primary velocity, said inlet means being disposed relative to said injection means such that a mixture of said primary fluid and said secondary fluid is formed in said admission channel, said mixture having a mass flow substantially equal to a sum of said primary mass flow and said secondary mass flow and a velocity toward said turbine that is less than said primary velocity; and means disposed within said election channel for receiving said mixture of said primary and said secondary fluids from said turbine at a given pressure and substantially adapting said given pressure to an ambient pressure outside of said body in a vicinity of said outlet means.

15. The device of claim 14, further comprising:

means for measuring a speed of rotation of said turbine, processing means for comparing said speed of rotation measured by said measuring means with a reference speed of rotation, and actuator means for modifying at least one parameter associated with said turbine device if said speed of rotation measured by said measuring means and said reference speed of rotation differ by a predetermined amount.

16. The device of claim 14 wherein, said injection means comprises a nozzle.

17. The device of claim 14 wherein, said injection means comprises at least one conduit adapted to inject said primary fluid into said admission channel via a wall of said body.

18. The device of claim 14 wherein, said injection means comprises at least one conduit having an inclination $\alpha$ with respect to an axis of said body and an inclination $\beta$ with respect to a radius of said body.

19. The device of claim 14, wherein said injection means comprises an annular space inside said admission channel, said annular space including a convergent section, a variable neck section and a divergent section.

20. The device of claim 14, wherein a direction of orientation of said ejection channel with respect to said admission channel is selected from a group comprising a radial direction and an axial direction.

21. The device of claim 14, wherein said measuring means comprises at least an upstream pressure sensor disposed within said body upstream from said turbine and a downstream pressure sensor disposed within said body downstream from said turbine.

22. The device of claim 14, further comprising actuator means for modifying at least one parameter associated with said turbine device, wherein said at least one parameter is selected from a group comprising:

a parameter associated with said injection means, a parameter associated with said inlet means, and a parameter associated with said outlet means.

23. The device of claim 22 further comprising processing means for controlling said actuator means.

24. The device of claim 14, wherein said turbine comprises a rotation shaft for engagedly contacting a mandrel rod of a tool.

25. The device of claim 14, wherein said turbine comprises blades and each of said blades has a constant chord, a constant thickness along a cylindrical section having for its axis that of said turbine, constant leading edge angles, and constant trailing edge angles.

26. The device of claim 14 further comprising an upstream distributor comprising blades and each of said blades has a constant chord, a constant thickness along a cylindrical section having for its axis that of said turbine, constant leading edge angles, and constant trailing edge angles.

* * * * *